US006710556B2

(12) United States Patent
Oda

(10) Patent No.: US 6,710,556 B2
(45) Date of Patent: Mar. 23, 2004

(54) DISCHARGE LAMP LIGHTING APPARATUS

(75) Inventor: Goichi Oda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/206,718

(22) Filed: Jul. 25, 2002

(65) Prior Publication Data

US 2003/0030387 A1 Feb. 13, 2003

(30) Foreign Application Priority Data

Aug. 10, 2001 (JP) ..... P. 2001-243667

(51) Int. Cl.[7] ..... G05F 1/00

(52) U.S. Cl. ..... 315/308; 315/224; 315/307; 315/DIG. 7; 315/291

(58) Field of Search ..... 315/307, 308, 315/224, 225, 291, 82, DIG. 7, 209 R

(56) References Cited

U.S. PATENT DOCUMENTS 5,295,036 A * 3/1994 Yagi et al. ..... 361/79
5,485,059 A * 1/1996 Yamashita et al. ..... 315/307
5,907,224 A * 5/1999 Yamashita et al. ..... 315/308
5,973,457 A * 10/1999 Yamashita et al. ..... 315/225
6,002,215 A * 12/1999 Yamashita et al. ..... 315/308
6,534,930 B2 * 3/2003 Ito et al. ..... 315/291

FOREIGN PATENT DOCUMENTS

| | | | |
|---|---|---|---|
| JP | 2001-138799 | 5/2001 | ..... B60Q/1/04 |
| JP | 2002-008882 | 1/2002 | ..... H05B/41/24 |
| JP | 2002-025788 | 1/2002 | ..... H05B/41/282 |
| JP | 2002-025790 | 1/2002 | ..... H05B/41/46 |

* cited by examiner

*Primary Examiner*—Hoang V. Nguyen
(74) *Attorney, Agent, or Firm*—Fish & Richardson P.C.

(57) ABSTRACT

In a discharge lamp lighting apparatus 1, power is supplied from a DC power supply 2 through a switch control circuit 3 to a lighting circuit 4 and a discharge lamp 5. Power is supplied to the lighting circuit through a semiconductor switch element 11 placed in a switch control circuit 8 and a part of the current flowing into a semiconductor switch element 12 is detected and is compared with reference values in comparators 21 and 22, thereby detecting an anomaly in the lighting circuit or the discharge lamp.

2 Claims, 2 Drawing Sheets

DISCHARGE LAMP LIGHTING APPARATUS

BACKGROUND OF THE INVENTION

This invention relates to a discharge lamp lighting apparatus using semiconductor switch elements to supply power to a lighting circuit, which detects an anomaly involved in power supply.

To detect an anomaly concerning power supply in a system using a discharge lamp, for example, the following modes are known:

(I) Mode in which an input current supplied from a power supply to a lighting circuit (so called, ballast circuit) is directly detected and whether or not an anomaly occurs is determined; and (II) mode in which an anomaly detection circuit is placed in a lighting circuit and detects an input current or its equivalent signal, whereby whether or not an anomaly occurs is determined.

However, the circuit modes in the related arts involve a problem about a power loss, costs, etc.

For example, in mode (I), occurrence of a power loss to detect a current flowing into a current detection element introduces a problem and in mode (II), addition of the anomaly detection circuit to the lighting circuit results in an increase in the number of parts, a rise in costs, complication of the configuration, etc.

If a mechanical switch of a relay, etc., is used for switch means in the discharge lamp lighting apparatus in the related art, there is a problem of limiting the anomaly detection method.

SUMMARY OF THE INVENTION

It is therefore an object of the invention to decrease a power loss and suppress a rise in costs in anomaly detection of a discharge lamp lighting apparatus.

To the end, according to the invention, a discharge lamp lighting apparatus comprises: a lighting circuit for lighting a discharge lamp upon reception of power supply from a DC power supply; a switch control circuit being placed between the lighting circuit and the DC power supply, which relays a power supplied from the DC power supply to the lighting circuit when the discharge lamp is lit; a circuit for supplying power to the lighting circuit through a semiconductor switch element placed in the switch control circuit, detecting a part of the current flowing into the semiconductor switch element, and comparing it with reference values, thereby detecting an anomaly in the lighting circuit or the discharge lamp is placed in the switch control circuit.

Therefore, according to the invention, a part of the current flowing into the semiconductor switch element is detected, whereby an anomaly can be detected and thus a power loss is lessened and an anomaly can be detected in the switch control circuit and thus the configuration is simplified and the circuit required for detecting an anomaly need not be placed in the lighting circuit.

DETAILED DESCRIPTION OF THE PREFERRED EMBODIMENTS

Figure 1:
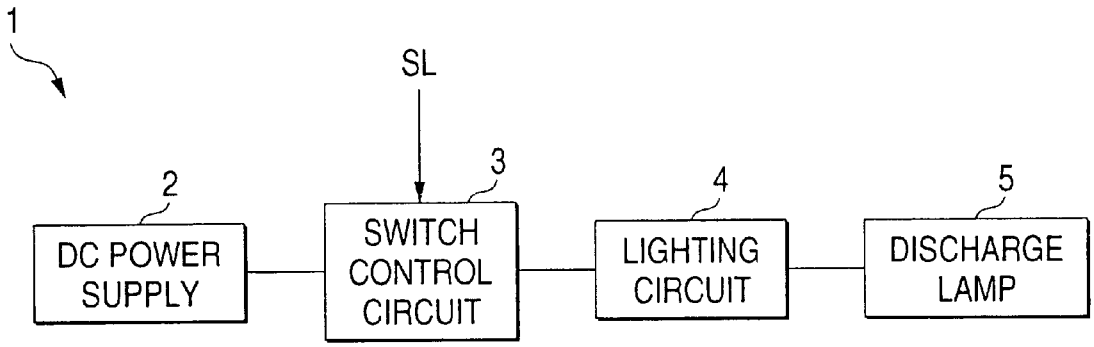
FIG. 1 is a block diagram to show the basic configuration of a discharge charge lamp lighting apparatus according to the invention.

FIG. 1 shows the basic configuration of a discharge lamp lighting apparatus according to the invention. The discharge lamp lighting apparatus 1 comprises the following components (each digit enclosed in parentheses is a reference numeral)

DC power supply (2);
switch control circuit (3);
lighting circuit (4); and
discharge lamp (5).

The switch control circuit 3 placed between the DC power supply 2 and the lighting circuit (ballast circuit) 4 supplies power from the DC power supply 2 to the lighting circuit 4 upon reception of a lighting command signal (SL) from a lamp switch (not shown) or an automatic lighting/extinguishing apparatus (not shown) when the discharge lamp 5 is lit. That is, power is supplied from the DC power supply 2 through the switch control circuit 3 to the lighting circuit 4 and the lighting circuit 4 receiving power supply starts and lights the discharge lamp 5.

Figure 2:
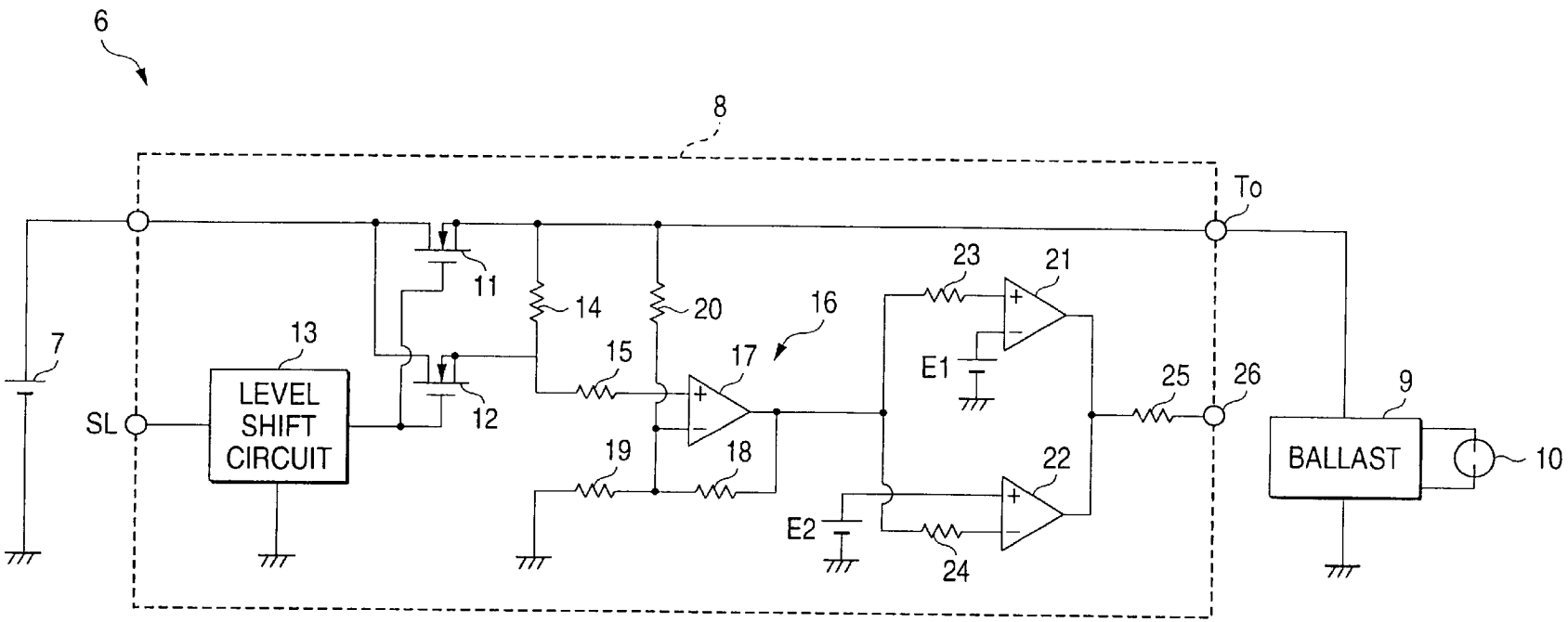
FIG. 2 is a circuit diagram to show an example of the invention.

FIG. 2 shows an example of the circuit configuration.

In a circuit 6, power is supplied from a battery 7 through a switch control circuit (or a lamp switch control circuit) 8 to a ballast circuit 9, lighting a discharge lamp 10. For example, in application to a vehicle headlamp, the discharge lamp 10 is used as a light source for dipped-beam (low-beam) application.

The switch control circuit 8 comprises semiconductor switch elements (in the example, field-effect transistors) through which power is supplied to the ballast circuit 9. For example, FETs 11 and 12 are made of a number of cells formed in a single chip, and the FET 11 has most of cells in the chip and the FET 12 has only a small number of cells. That is, the FET 11 has large current capacity, whereas the FET 12 has small current capacity. Thus, the major portion of the current flowing into the ballast circuit 9 passes through the FET 11 and only some current flows into the FET 12. Considering a power loss, it is preferably at least 1% or less current as the ratio to whole current.

In the example, each of the FETs 11 and 12 is an n-channel MOS (metal oxide semiconductor) FET and has a drain connected to a positive terminal of the battery 7 and a gate to which a signal from a level shift circuit 13 is supplied. The FET 11 has a source connected to a power supply terminal To to the ballast circuit 9 and connected via a resistor 14 to a source of the FET 12. The source of the FET 12 is connected via a resistor 15 to an amplifier 16 described later.

The signal SL from the lamp switch, etc., is input to the level shift circuit 13 and is converted into a predetermined-level voltage and then the voltage is supplied to the gates of the FETs 11 and 12, turning on the FETs 11 and 12.

The amplifier 16 uses an operational amplifier 17, which has a noninverting input terminal connected via the resistor 15 to the source of the FET 12. The operational amplifier 17 has an inverting input terminal connected to a connection point of resistors 18 and 19 placed between an output terminal of the operational amplifier 17 and a ground line and connected via a resistor 20 to the source of the FET 11.

An output signal of the amplifier 16 is sent to two comparators 21 and 22 and is compared with predetermined reference values. That is, the output signal of the amplifier 16 is input via a resistor 23 to a positive input terminal of the comparator 21 and is compared with a reference voltage E1 (indicated by a symbol of a constant voltage source connected to a negative input terminal in the figure). The output signal of the amplifier 16 is input via a resistor 24 to a negative input terminal of the comparator 22 and is compared with a reference voltage E2 (indicated by a symbol of a constant voltage source connected to a positive input terminal in the figure). The output signal of each comparator is sent via a resistor 25 to a signal output terminal 26.

In the circuit 6, when the signal SL is received by the level shift circuit 13 and the FETs 11 and 12 are turned on, power supply from the battery 7 is received and the ballast circuit 9 operates, lighting the discharge lamp 10. At the time, most current flows into the FET 11 on a power supply line and an extremely slight current corresponding to a predetermined ratio flows into the FET 12. The source of the FET 12 is provided with the resistors 14 and 15 for detecting the current and the result of amplifying the detection voltage by the amplifier 16 is sent to the comparators 21 and 22 and is compared with the reference voltages E1 and E2. For example, if the level of the output signal of the amplifier 16 becomes equal to or greater than E1, the comparator 21 outputs a high signal, and when the output signal level becomes equal to or less than E2, the comparator 22 outputs a high signal. Accordingly, as for detection of the input current from the power supply, for example, if the level is less than E2 or is equal to or greater than E1, it is determined that an anomaly occurs, and a determination signal is provided through the signal output terminal 26.

Thus, the circuit for detecting a part of the current flowing into the semiconductor switch element (or switching element) and comparing it with the reference values, thereby detecting an anomaly in the lighting circuit or the discharge lamp is placed in the switch control circuit and can easily determine an anomaly in the ballast circuit, a switch-off anomaly of the discharge lamp, etc., caused by an overcurrent, for example, based on the input current from the DC power supply.

The cells in the semiconductor switch element chip are classified into those for current supply and those for current detection for use. The field-effect transistor consisting of a large number of cells can be used to supply power to the lighting circuit and the field-effect transistor consisting of a small number of cells can be used to detect current and thus the power loss at the current detection time can be minimized.

For example, the signal provided through the signal output terminal 26 can be used as an anomaly notification signal for producing warning indication, an alarm, etc., for the user or the signal or the current detection value at the time can be sent to a diagnosis circuit (not shown), whereby the anomaly contents can be recorded for use as a clue for troubleshooting, taking steps, countermeasures, etc. In addition, the signal can be sent to the level shift circuit 13 for turning off the FETs 11 and 12 or can be sent to the ballast circuit 9 for shutting off power supply to the discharge lamp (various modes are known in which the signal is sent to a DC-DC conversion section or a DC-AC conversion section in the ballast circuit for stopping the operation, for example), of course.

As seen from the description given above, according to the invention, a part of the current flowing into the semiconductor switch element is detected, whereby an anomaly can be detected and thus a power loss is lessened. Since an anomaly can be detected in the switch control circuit, the configuration is simplified and the circuit required for detecting an anomaly need not be placed in the lighting circuit. Since the semiconductor switch elements are used, the anomaly detection method and circuit configuration are not limited to specific ones.

According to the invention, the field-effect transistor consisting of a small number of cells is used to detect current, whereby only the necessary minimum current is required and moreover the detrimental effect of a cost rise, etc., is not involved.

What is claimed is:

1. A discharge lamp lighting apparatus comprising:

a lighting circuit for lighting a discharge lamp upon reception of power supply from a DC power supply:

a switch control circuit placed between the lighting circuit and the DC power supply, which relays power supplied from the DC power supply to the lighting circuit, when the discharge lamp is lit; and a circuit for supplying power to the lighting circuit through a first semiconductor switch element placed in the switch control circuit, for detecting a part of the current flowing into the first semiconductor switch element, and for comparing the detected current with reference values, thereby detecting an anomaly in the lighting circuit or the discharge lamp placed in the switch control circuit, wherein the first semiconductor switch element comprises a field-effect transistor that includes a large number of cells to supply power to the lighting circuit, and a second semiconductor switch element comprises a field-effect transistor that includes a smaller number of cells to detect a part of the current flowing into the first semiconductor switch element.

2. A discharge lamp lighting apparatus comprising:

a lighting circuit for lighting a discharge lamp upon reception of power supply from a DC power supply;

a switch control circuit placed between the lighting circuit and the DC power supply, including a first semiconductor switch element for supplying the power to the lighting circuit, a second semiconductor switch element for detecting a part of the current flowing into the first semiconductor switch element, and a comparator for comparing the detected current with reference values, thereby detecting an anomaly in the lighting circuit or the discharge lamp placed in the switch control circuit.

* * * * *